US010100819B2

(12) United States Patent
Hahn et al.

(10) Patent No.: US 10,100,819 B2
(45) Date of Patent: Oct. 16, 2018

(54) LINEAR COMPRESSOR

(71) Applicant: General Electric Company, Schenectady, NY (US)

(72) Inventors: Gregory William Hahn, Louisville, KY (US); Thomas Robert Barito, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 259 days.

(21) Appl. No.: 15/007,309

(22) Filed: Jan. 27, 2016

(65) Prior Publication Data

US 2017/0211562 A1 Jul. 27, 2017

(51) Int. Cl.

| | |
|---|---|
| ***F04B 35/04*** | (2006.01) |
| ***F04B 39/00*** | (2006.01) |
| ***F04B 39/12*** | (2006.01) |
| ***F25B 31/02*** | (2006.01) |

(52) U.S. Cl.

CPC ..... *F04B 35/045* (2013.01); *F04B 39/0005* (2013.01); *F04B 39/0022* (2013.01); *F04B 39/12* (2013.01); *F04B 39/123* (2013.01); *F25B 31/023* (2013.01); *F25B 2400/073* (2013.01)

(58) Field of Classification Search

CPC .... F04B 9/04; F04B 9/047; F04B 9/02; F04B 35/01; F04B 35/045; F04B 53/14; F04B 39/0022; Y10T 403/32688; Y10T 403/32762; Y10T 403/32811; F16J 1/14; F16J 1/22

See application file for complete search history.

(56) References Cited

U.S. PATENT DOCUMENTS

| | | | | |
|---|---|---|---|---|
| 2,500,669 | A * | 3/1950 | Doeg | F04B 39/0005 403/144 |
| 3,282,602 | A * | 11/1966 | Willingshofer | B60G 7/005 280/124.134 |
| 3,831,729 | A * | 8/1974 | Howard | B41J 2/285 335/274 |
| 5,146,124 | A * | 9/1992 | Higham | F16F 7/116 310/17 |
| 7,316,547 | B2 | 1/2008 | Lilie | |
| 7,626,289 | B2 | 12/2009 | Her | |
| 2001/0014292 | A1* | 8/2001 | Kawahara | F04B 35/045 417/417 |
| 2005/0013658 | A1* | 1/2005 | Muders | F16C 11/0614 403/122 |
| 2015/0226197 | A1 | 8/2015 | Hahn et al. | |

FOREIGN PATENT DOCUMENTS

| | | | |
|---|---|---|---|
| JP | 2001123949 | A | 5/2001 |

* cited by examiner

*Primary Examiner* — Kenneth J Hansen
(74) *Attorney, Agent, or Firm* — Dority & Manning, P.A.

(57) ABSTRACT

The present subject matter provides a linear compressor. The linear compressor includes a coupling that extends between an inner back iron assembly and a piston. The coupling includes a shaft and a ball seat mounted to the shaft at an end portion of the shaft. A ball is positioned on the ball seat at a seating surface of the ball seat. A ball shoe is positioned opposite the ball seat about the ball, and the ball is positioned on the seating surface of the ball shoe. A spring urges the ball shoe against the ball.

17 Claims, 5 Drawing Sheets

LINEAR COMPRESSOR

FIELD OF THE INVENTION

The present subject matter relates generally to linear compressors and couplings for linear compressors.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil generates a force for sliding the piston forward and backward within a chamber. During motion of the piston within the chamber, the piston compresses refrigerant. However, friction between the piston and a wall of the chamber can negatively affect operation of the linear compressors if the piston is not suitably aligned within the chamber. In particular, friction losses due to rubbing of the piston against the wall of the chamber can negatively affect an efficiency of an associated refrigerator appliance.

Accordingly, a linear compressor with features for limiting friction between a piston and a wall of a cylinder during operation of the linear compressor would be useful.

BRIEF DESCRIPTION OF THE INVENTION

The present subject matter provides a linear compressor. The linear compressor includes a coupling that extends between an inner back iron assembly and a piston. The coupling includes a shaft and a ball seat mounted to the shaft at an end portion of the shaft. A ball is positioned on the ball seat at a seating surface of the ball seat. A ball shoe is positioned opposite the ball seat about the ball, and the ball is positioned on the seating surface of the ball shoe. A spring urges the ball shoe against the ball. Additional aspects and advantages of the invention will be set forth in part in the following description, or may be apparent from the description, or may be learned through practice of the invention.

In a first exemplary embodiment, a linear compressor is provided. The linear compressor includes a driving coil. An inner back iron assembly is positioned at least partially in the driving coil. A magnet is mounted to the inner back iron assembly. The driving coil is configured for magnetically engaging the magnet in order to reciprocate the inner back iron assembly relative to the driving coil. A coupling extends between the inner back iron assembly and a piston. The coupling includes a shaft and a ball seat mounted to the shaft at an end portion of the shaft. The ball seat defines a seating surface. A ball is positioned on the ball seat at the seating surface of the ball seat. An outer surface of the ball is complementary to the seating surface of the ball seat. A ball shoe is positioned opposite the ball seat about the ball. The ball shoe defines a seating surface. The ball is positioned on the seating surface of the ball shoe. The outer surface of the ball is complementary to the seating surface of the ball shoe. A housing is mounted to the ball seat and positioned over the ball and the ball shoe. A spring is positioned within the housing. The spring urges the ball shoe against the ball.

In a second exemplary embodiment, a linear compressor is provided. The linear compressor includes a driving coil and an inner back iron assembly positioned at least partially in the driving coil. The driving coil is configured for magnetically engaging a magnet in the inner back iron assembly in order to reciprocate the inner back iron assembly relative to the driving coil. A coupling extends between the inner back iron assembly and the piston. The coupling includes a shaft and a pair of ball joints. Each ball joint of pair of the ball joints includes a ball seat, a ball, a ball shoe, a housing and a spring. For each ball joint of the pair of ball joints, the ball seat is mounted to the shaft at an end portion of the shaft, the ball seat defines a seating surface, the ball is positioned on the ball seat at the seating surface of the ball seat, an outer surface of the ball is complementary to the seating surface of the ball seat, the ball shoe is positioned opposite the ball seat about the ball, the ball shoe defines a seating surface, the ball is positioned on the seating surface of the ball shoe, the outer surface of the ball is complementary to the seating surface of the ball shoe, the housing is mounted to the ball seat and positioned over the ball and the ball shoe, the spring is positioned within the housing and the spring urges the ball shoe against the ball.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
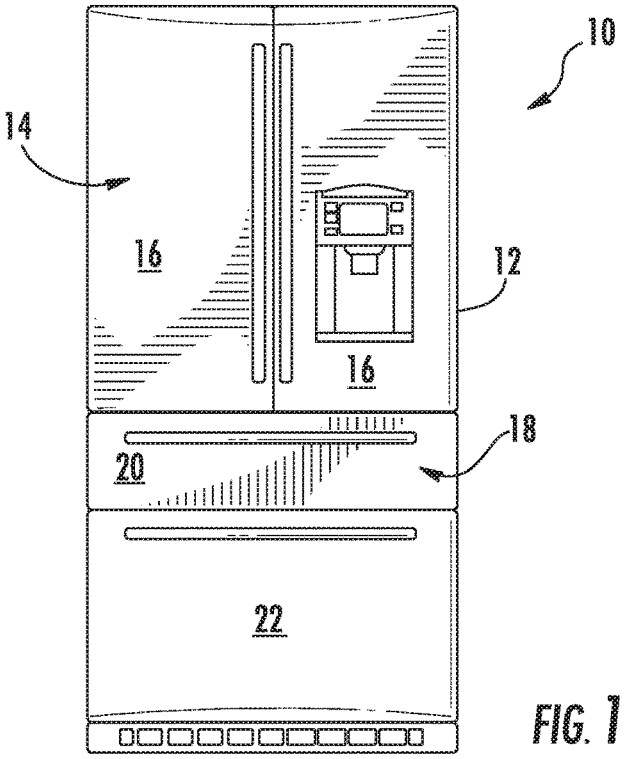
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
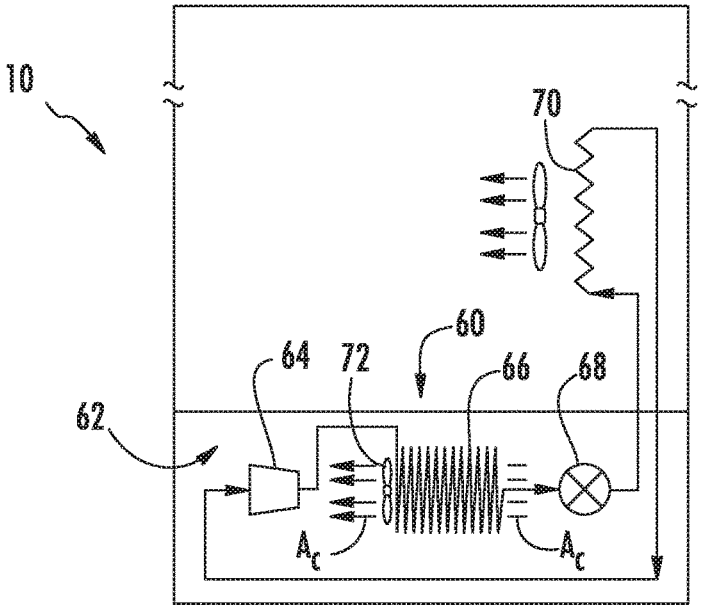
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
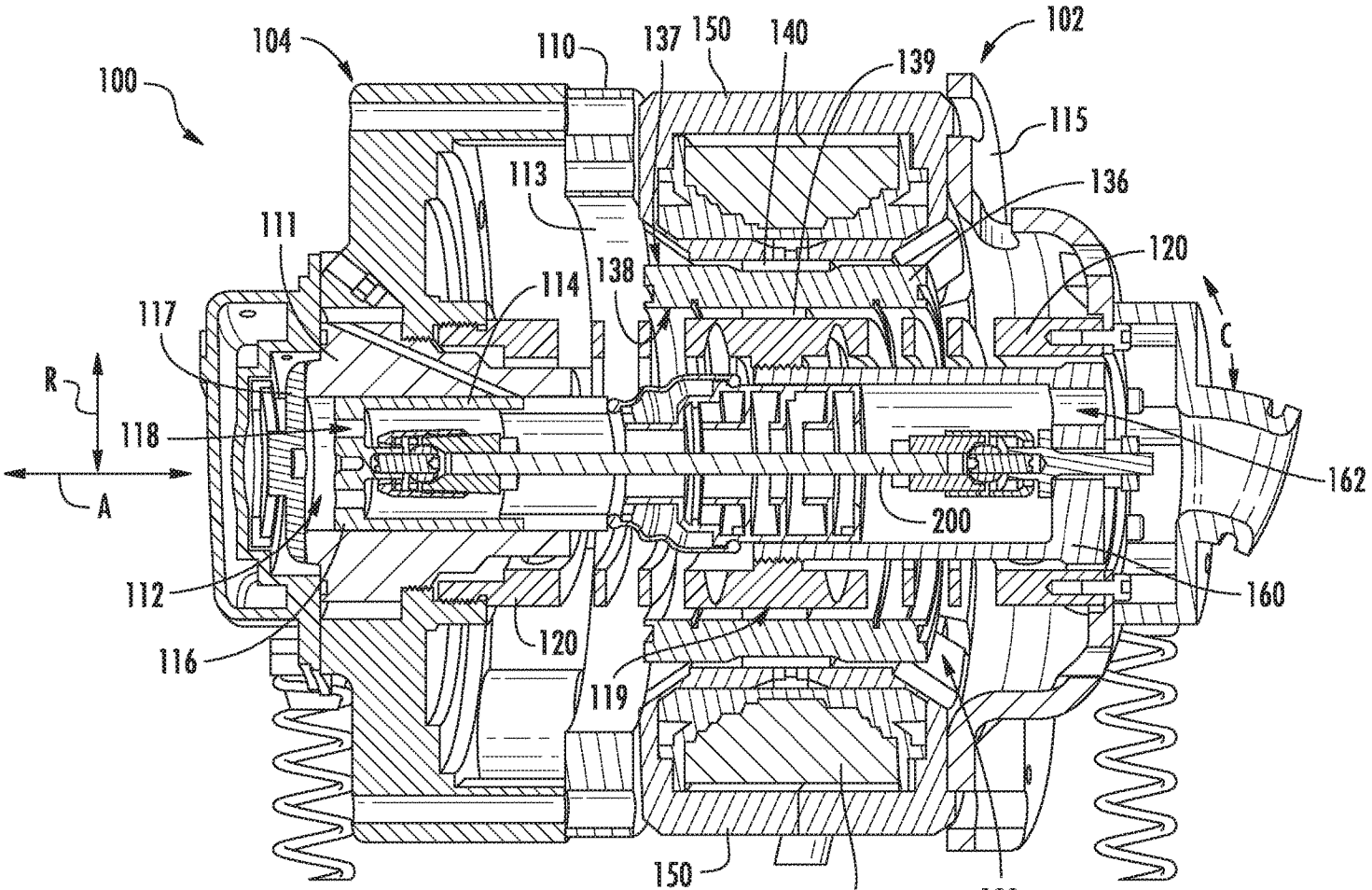
FIG. 3 provides a section view of a linear compressor according to an exemplary embodiment of the present subject matter.

FIG. 3 provides a section view of a linear compressor 100 according to an exemplary embodiment of the present subject matter. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Turning now to FIG. 3, linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. Casing 110 also includes a motor mount mid-section 113 and an end cap 115 positioned opposite each other about a motor. A stator, e.g., including an outer back iron 150 and a driving coil 152, of the motor is mounted or secured to casing 110, e.g., such that the stator is sandwiched between motor mount mid-section 113 and end cap 115 of casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

As may be seen in FIG. 3, linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction C. Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap. Thus, the air gap may be defined between opposing surfaces of driving magnet 140 and driving coil 152. Driving magnet 140 may also be mounted or fixed to inner back iron assembly 130 such that an outer surface of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap between outer back iron 150 and inner back iron assembly 130 during operation of linear compressor 100, and linear compressor 100 may be more efficient relative to linear compressors with air gaps on both sides of a driving magnet.

As may be seen in FIG. 3, driving coil 152 extends about inner back iron assembly 130, e.g., along the circumferential direction C. Driving coil 152 is operable to move the inner back iron assembly 130 along the axial direction A during operation of driving coil 152. As an example, a current may be induced within driving coil 152 by a current source (not shown) to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 and piston head 116 along the axial direction A during operation of driving coil 152. Thus, driving coil 152 may slide piston assembly 114 between the top dead center position and the bottom dead center position, e.g., by moving inner back iron assembly 130 along the axial direction A, during operation of driving coil 152.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by inducing current in driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 100 also includes a spring 120. Spring 120 is positioned in inner back iron assembly 130. In particular, inner back iron assembly 130 may extend about spring 120, e.g., along the circumferential direction C. Spring 120 also extends between first and second end portions 102 and 104 of casing 110, e.g., along the axial direction A. Spring 120 assists with coupling inner back iron assembly 130 to casing 110, e.g., cylinder assembly 111 of casing 110. In particular, inner back iron assembly 130 is fixed to spring 120 at a middle portion of spring 120 as discussed in greater detail below.

During operation of driving coil 152, spring 120 supports inner back iron assembly 130. In particular, inner back iron assembly 130 is suspended by spring 120 within the stator or the motor of linear compressor 100 such that motion of inner back iron assembly 130 along the radial direction R is hindered or limited while motion along the axial direction A is relatively unimpeded. Thus, spring 120 may be substantially stiffer along the radial direction R than along the axial direction A. In such a manner, spring 120 can assist with maintaining a uniformity of the air gap between driving magnet 140 and driving coil 152, e.g., along the radial direction R, during operation of the motor and movement of inner back iron assembly 130 on the axial direction A. Spring 120 can also assist with hindering side pull forces of the motor from transmitting to piston assembly 114 and being reacted in cylinder assembly 111 as a friction loss.

Inner back iron assembly 130 includes an outer cylinder 136 and a sleeve 139. Outer cylinder 136 defines outer surface 137 of inner back iron assembly 130 and also has an inner surface 138 positioned opposite outer surface 137 of outer cylinder 136. Sleeve 139 is positioned on or at inner surface 138 of outer cylinder 136. A first interference fit between outer cylinder 136 and sleeve 139 may couple or secure outer cylinder 136 and sleeve 139 together. In alternative exemplary embodiments, sleeve 139 may be welded, glued, fastened, or connected via any other suitable mechanism or method to outer cylinder 136.

Sleeve 139 extends about spring 120, e.g., along the circumferential direction C. In addition, a middle portion of spring 120 is mounted or fixed to inner back iron assembly 130 with sleeve 139. Sleeve 139 extends between inner surface 138 of outer cylinder 136 and the middle portion of spring 120, e.g., along the radial direction R. A second interference fit between sleeve 139 and the middle portion of spring 120 may couple or secure sleeve 139 and the middle portion of spring 120 together. In alternative exemplary embodiments, sleeve 139 may be welded, glued, fastened, or connected via any other suitable mechanism or method to the middle portion of spring 120.

Outer cylinder 136 may be constructed of or with any suitable material. For example, outer cylinder 136 may be constructed of or with a plurality of (e.g., ferromagnetic) laminations. The laminations are distributed along the circumferential direction C in order to form outer cylinder 136 and are mounted to one another or secured together, e.g., with rings pressed onto ends of the laminations. Outer cylinder 136 defines a recess that extends inwardly from outer surface 137 of outer cylinder 136, e.g., along the radial direction R. Driving magnet 140 is positioned in the recess on outer cylinder 136, e.g., such that driving magnet 140 is inset within outer cylinder 136.

A piston flex mount 160 is mounted to and extends through inner back iron assembly 130. In particular, piston flex mount 160 is mounted to inner back iron assembly 130 via sleeve 139 and spring 120. Thus, piston flex mount 160 may be coupled (e.g., threaded) to spring 120 at the middle portion of spring 120 in order to mount or fix piston flex mount 160 to inner back iron assembly 130. A coupling 200 extends between piston flex mount 160 and piston assembly 114, e.g., along the axial direction A. Thus, coupling 200 connects inner back iron assembly 130 and piston assembly 114 such that motion of inner back iron assembly 130, e.g., along the axial direction A, is transferred to piston assembly 114. Coupling 200 may extend through driving coil 152, e.g., along the axial direction A.

Coupling 200 may be a compliant coupling that is compliant or flexible along the radial direction R. In particular, coupling 200 may be sufficiently compliant along the radial direction R such that little or no motion of inner back iron assembly 130 along the radial direction R is transferred to piston assembly 114 by coupling 200. In such a manner, side pull forces of the motor are decoupled from piston assembly 114 and/or cylinder assembly 111 and friction between piston assembly 114 and cylinder assembly 111 may be reduced.

Piston flex mount 160 defines at least one suction gas inlet 162. Suction gas inlet 162 of piston flex mount 160 extends, e.g., along the axial direction A, through piston flex mount 160. Thus, a flow of fluid, such as air or refrigerant, may pass through piston flex mount 160 via suction gas inlet 162 of piston flex mount 160 during operation of linear compressor 100.

Piston head 116 also defines at least one opening 118. Opening 118 of piston head 116 extends, e.g., along the axial direction A, through piston head 116. Thus, the flow of fluid may pass through piston head 116 via opening 118 of piston head 116 into chamber 112 during operation of linear compressor 100. In such a manner, the flow of fluid (that is compressed by piston head 116 within chamber 112) may flow through piston flex mount 160 and inner back iron assembly 130 to piston assembly 114 during operation of linear compressor 100.

Figure 4:
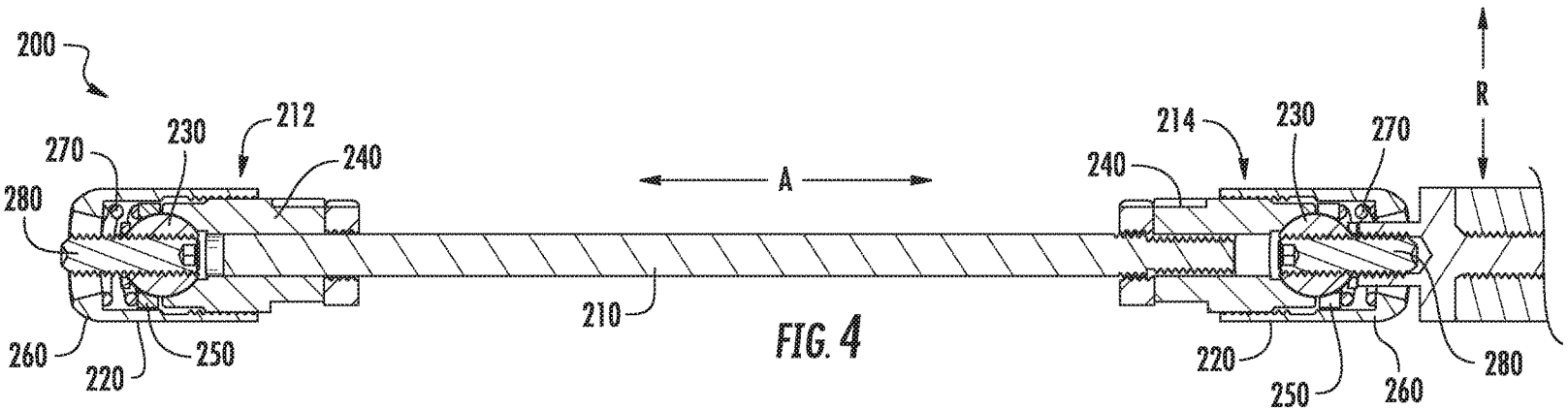
FIG. 4 provides a partial, section view of a coupling of the exemplary linear compressor of FIG. 3.

FIG. 4 provides a partial, section view of coupling 200. As discussed in greater detail below, coupling 200 includes features for limiting transfer of motion of inner back iron assembly 130 along the radial direction R to piston assembly 114. It should be understood that while described below in context of linear compressor 100, coupling 200 may be used in or within any other suitable compressor in alternative exemplary embodiments.

As may be seen in FIG. 4, coupling 200 includes a shaft 210 and a pair of ball joints 220. Ball joints 220 are mounted to shaft 210 and are positioned at opposite ends of shaft 210. In particular, shaft 210 extends between a first end portion 212 and a second end portion 214, e.g., along the axial direction A. One of ball joints 220 is mounted to shaft 210 at or adjacent first end portion 212 of shaft 210, and another one of ball joints 220 is mounted to shaft 210 is mounted to shaft 210 at or adjacent second end portion 214 of shaft 210. Thus, ball joints 220 may be spaced apart from each other along the axial direction A on shaft 210.

First end portion 212 of shaft 210 may be positioned at or adjacent piston assembly 114, and second end portion 214 of shaft 210 may be positioned at or adjacent inner back iron assembly 130. The one of ball joints 220 at first end portion 212 of shaft 210 may be coupled or connected to piston assembly 114, and the another one of ball joints 220 may be coupled or connected to inner back iron assembly 130. In such a manner, shaft 210 and ball joints 220 may assist with coupling piston assembly 114 and inner back iron assembly 130 together such that motion of inner back iron assembly 130 along the axial direction A is transferred to piston assembly 114 via coupling 200.

Ball joints 220 assist with limiting transfer of motion of inner back iron assembly 130 along the radial direction R to piston assembly 114. For example, ball joints 220 may be compliant or rotatable, e.g., along the radial direction R and/or circumferential direction C. Ball joints 220 are discussed in greater detail below in the context of FIG. 5.

Figure 5:
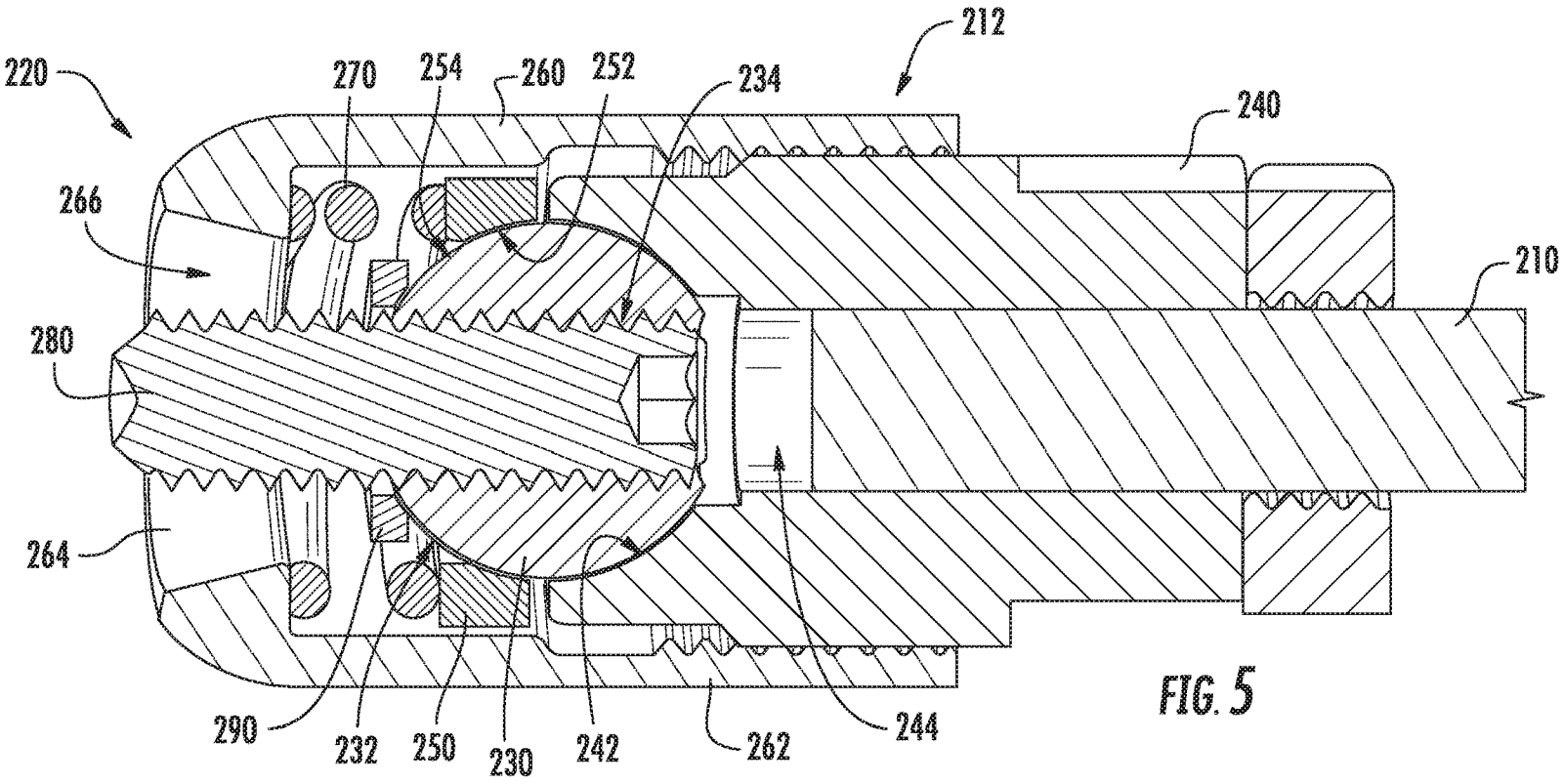
FIG. 5 provides a section view of a ball joint of the coupling of FIG. 4.

FIG. 5 provides a section view of one of ball joints 220. It should be understood that both ball joints 220 may be constructed in the same or similar manner to ball joint 220 shown in FIG. 5. As may be seen in FIG. 5, ball joint 220 includes a ball 230, a ball seat 240, a ball shoe 250, a housing 260 and a spring 270.

Ball seat 240 is mounted to shaft 210 at an end portion of shaft 210, e.g., either of first end portion 212 or second end portion 214 of shaft 210. Ball seat 240 may be mounted to shaft 210 using any suitable method or mechanism. As an example, ball seat 240 may be threaded, press-fit, welded, adhered, fastened, etc. to shaft 210. Ball seat 240 also defines a seating surface 242 and a passage 244. A portion of shaft 210 may be disposed within passage 244. In particular, shaft 210 may be threaded or otherwise mounted to ball seat 240 at passage 244 of ball seat 240. As an example, ball seat 240 may be cylindrical with shaft 210 positioned at or within a central portion of ball seat 240.

Ball shoe 250 is positioned opposite ball seat 240 about ball 230. Thus, ball 230 may be disposed between ball seat 240 and ball shoe 250, e.g., along the axial direction A. In particular, ball 230 may be disposed between ball seat 240 and ball shoe 250 such that ball seat 240 and ball shoe 250 are spaced apart from each other, e.g., along the axial direction A. Ball shoe 250 defines a seating surface 252 and a circular opening 254, e.g., in a plane that is perpendicular to the axial direction A. Thus, ball shoe 250 may be annular.

Ball 230 is positioned on ball seat 240 at seating surface 242 of ball seat 240. Thus, ball 230 may contact and slide on ball seat 240 at seating surface 242 of ball seat 240. Ball 230 is also positioned on ball shoe 250 at seating surface 252 of ball shoe 250. Thus, ball 230 may contact and slide on ball shoe 250 at seating surface 252 of ball shoe 250. In such a manner, ball 230 is rotatable or movable relative to ball seat 240 and ball shoe 250.

Ball 230 defines an outer surface 232 and a central passage 234. Outer surface 232 of ball 230 may be complementary to seating surface 242 of ball seat 240 and/or complementary to seating surface 252 of ball shoe 250. As an example, outer surface 232 of ball 230 may be spherical, and seating surface 242 of ball seat 240 and seating surface 252 of ball shoe 250 may both be semispherical. Thus, seating surface 242 of ball seat 240 and seating surface 252 of ball shoe 250 may be shaped to receive outer surface 232 of ball 230, and respective portions of outer surface 232 of ball 230 may contact and slide on seating surface 242 of ball seat 240 and seating surface 252 of ball shoe 250 in order to permit movement of ball 230 relative to ball seat 240 and ball shoe 250.

Housing 260 is mounted to ball seat 240 such that housing 260 is positioned over ball 230 and ball shoe 250. Housing 260 may be mounted to ball seat 240 using any suitable method or mechanism. As an example, housing 260 may be threaded, press-fit, welded, adhered, fastened, etc. to ball seat 240. Housing 260 may be cylindrical and include a side wall 262 and end wall 264. Side wall 262 of housing 260 may extend around ball 230 and ball shoe 250, e.g., along the circumferential direction C (FIG. 3). End wall 264 of housing 260 may be positioned such that end wall 264 of housing 260 is spaced apart from ball seat 240, e.g., along the axial direction A. Thus, ball 230 and/or ball shoe 250 may be positioned between end wall 264 of housing 260 and ball seat 240, e.g., along the axial direction A.

Spring 270 is also positioned or disposed within housing 260. Spring 270 may be compressed within housing 260 such that spring 270 urges ball shoe 250 against ball 230. In particular, spring 270 may extend between ball shoe 250 and end wall 264 of housing 260 within housing 260 such that spring 270 is compressed between ball shoe 250 and end wall 264 of housing 260. Spring 270 may assist with reducing chatter or other translation of ball 230 along the axial direction A relative to ball seat 240 and/or ball shoe 250.

Coupling 200 may also include a post or stud 280. Stud 280 may assist with mounting or coupling ball joint 220 to one of piston assembly 114 and inner back iron assembly 130. As an example, stud 280 may be threaded to one of piston assembly 114 and inner back iron assembly 130 in order to mount ball joint 220 to piston assembly 114 or inner back iron assembly 130. In alternative exemplary embodiments, stud 280 may be press-fit or otherwise suitably mounted to one of piston assembly 114 and inner back iron assembly 130. Stud 280 may be threaded or press-fit to ball 230 at central passage 234, e.g., such that at least a portion of stud 280 is disposed within central passage 234. Stud 280 may extend through end wall 264 of housing 260 at an opening 266 to piston assembly 114 or inner back iron assembly 130. Opening 266 may be frustoconical, e.g., to avoid blocking or limiting movement of stud 280 within opening 266 during rotation of ball 230 relative to ball seat 240 and ball shoe 250. Coupling 200 may further include a washer 290 that extends around stud 280 within housing 260, e.g., to protect piston assembly 114 and inner back iron assembly 130 when ball 230 is tightened against washer 290.

To assemble ball joint 220, threaded stud 280 may be threaded to ball 230 at central passage 234. Ball 230 may then be inserted into housing 260 with ball shoe 250 and spring 270. Housing 260, e.g., side wall 262 of housing 260, may then be threaded onto ball seat 240 until spring 270 is compressed between ball shoe 250 and end wall 264 of housing 260. Threaded stud 280 may then be threaded to piston assembly 114 or inner back iron assembly 130 by inserting a tool, such as an Allen wrench, through passage 244 of ball seat 240 to threaded stud 280. Shaft 210 may then be inserted into passage 244 of ball seat 240 and mounted to ball seat 240.

With ball 230, e.g., rigidly, mounted or coupled to one of piston assembly 114 and inner back iron assembly 130 and with ball seat 240 mounted shaft 210, ball joint 210 may limit transfer of motion of inner back iron assembly 130 along the radial direction R to piston assembly 114. For example, ball joints 220 may make coupling 200 compliant along the radial direction R such that little or no motion of inner back iron assembly 130 along the radial direction R is transferred to piston assembly 114 by coupling 200. In such a manner, side pull forces of the motor of linear compressor 100 are decoupled from piston assembly 114 and/or cylinder assembly 111 and friction between piston assembly 114 and cylinder assembly 111 may be reduced.

Figure 6:
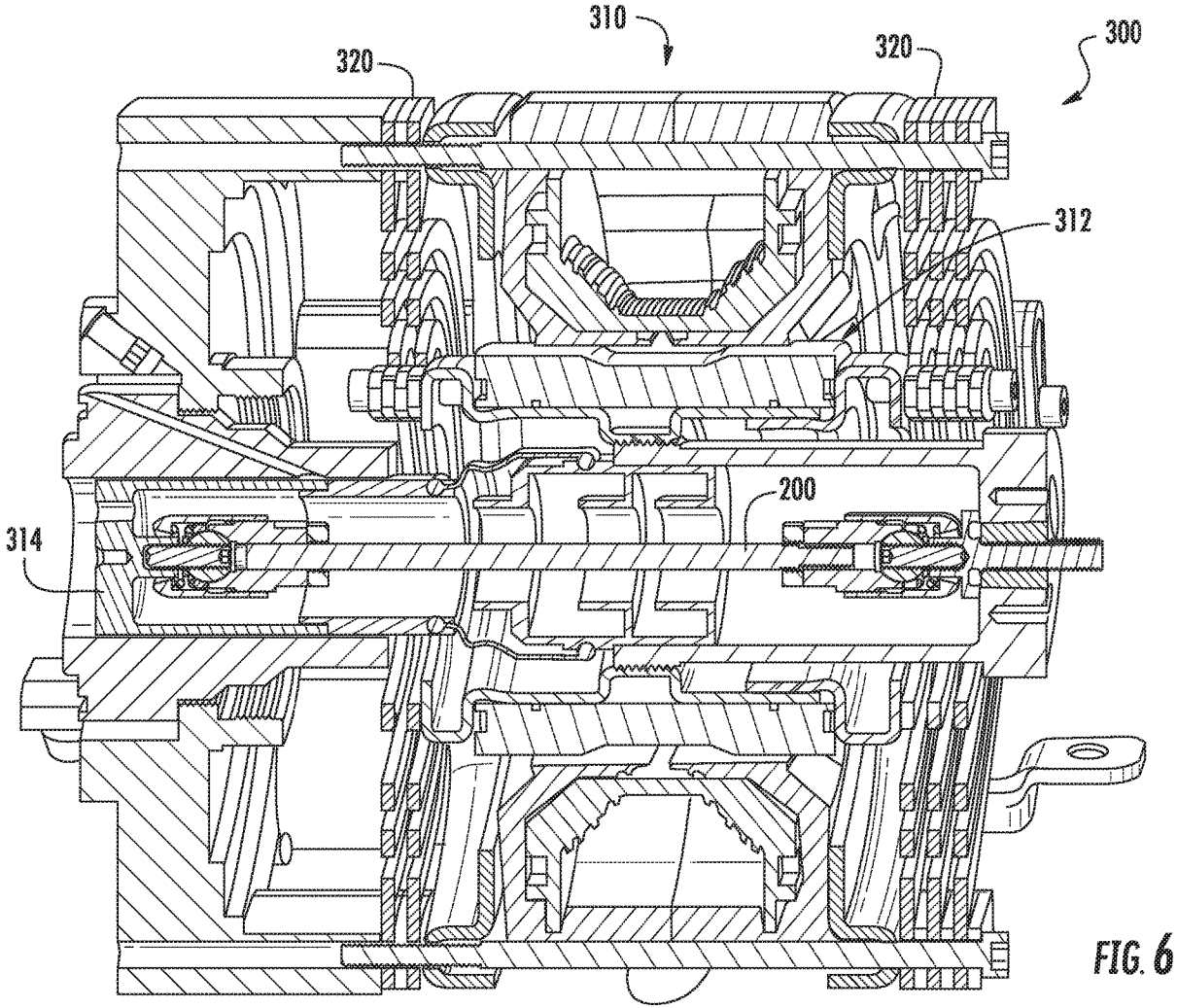
FIG. 6 provides a section view of a linear compressor according to another exemplary embodiment of the present subject matter with the coupling of FIG. 4.

FIG. 6 provides a section view of a linear compressor 300 according to another exemplary embodiment of the present subject matter. Linear compressor 300 may be constructed in a similar manner to linear compressor 100 (FIG. 3) and may include common components such that linear compressor 300 operates in a similar manner. As may be seen in FIG. 6, linear compressor 300 includes a motor 310, a movable inner back iron 312 and a piston 314. Planar springs 320 support inner back iron 312 rather than spring 120 of linear compressor 100. Linear compressor 300 may be constructed in the same or similar manner to the linear compressor described in U.S. Patent Publication No. 2015/0226197 of Gregory William Hahn et al., which is hereby incorporated by reference in its entirety for all purposes. As shown in FIG. 6, coupling 200 extends between an couples inner back iron 312 and a piston 314. Thus, to reiterate, coupling 200 may be used in or within any other suitable compressor in alternative exemplary embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A linear compressor, comprising:

a driving coil;

an inner back iron assembly positioned at least partially in the driving coil;

a magnet mounted to the inner back iron assembly, the driving coil configured for magnetically engaging the magnet in order to reciprocate the inner back iron assembly relative to the driving coil;

a piston; and a coupling extending between the inner back iron assembly and the piston, the coupling comprising a ball seat defining a channel and a seating surface;

a shaft having an end portion, the end portion of the shaft being mounted within the channel of the ball seat;

a ball defining a central passage and being positioned on the ball seat at the seating surface of the ball seat, an outer surface of the ball being complementary to the seating surface of the ball seat;

a ball shoe positioned opposite the ball seat about the ball, the ball shoe defining a circular opening and a seating surface, the ball positioned on the seating surface of the ball shoe, the outer surface of the ball being complementary to the seating surface of the ball shoe;

a housing mounted to the ball seat and positioned over the ball and the ball shoe;

a spring positioned within the housing, the spring urging the ball shoe against the ball; and a threaded stud received within the central passage of the ball and one of the inner back iron assembly or the piston, the threaded stud passing through the circular opening of the ball shoe.

2. The linear compressor of claim 1, wherein the coupling defines an axial direction, the shaft extending between a first end portion and a second end portion along the axial direction, the ball seat and the ball shoe spaced apart from each other along the axial direction.

3. The linear compressor of claim 2, wherein the first end portion of the shaft is positioned at the piston and the second end portion of the shaft is positioned at the inner back iron assembly, the ball seat is mounted to the shaft at the first end portion of the shaft.

4. The linear compressor of claim 2, wherein the first end portion of the shaft is positioned at the piston and the second end portion of the shaft is positioned at the inner back iron assembly, the ball seat is mounted to the shaft at the second end portion of the shaft.

5. The linear compressor of claim 1, wherein the housing comprises a cylindrical sidewall and an end wall, the end wall of the housing defining a frustoconical opening, the threaded stud passing through the frustoconical opening away from the shaft along an axial direction.

6. The linear compressor of claim 5, wherein the spring extends between the ball shoe and the end wall of the housing within the housing.

7. The linear compressor of claim 1, wherein the outer surface of the ball is spherical, the seating surface of the ball seat and the seating surface of the ball shoe being semi spherical.

8. The linear compressor of claim 1, wherein the housing is threaded onto the ball seat.

9. A linear compressor, comprising:

a driving coil;

an inner back iron assembly positioned at least partially in the driving coil, the driving coil configured for magnetically engaging a magnet in the inner back iron assembly in order to reciprocate the inner back iron assembly relative to the driving coil;

a piston; and a coupling extending between the inner back iron assembly and the piston, the coupling comprising a shaft; and a pair of ball joints, each ball joint of the pair of the ball joints comprising a ball seat, a ball, a ball shoe, a housing and a spring, wherein, for each ball joint of the pair of ball joints, the shaft is mounted within a channel defined by the ball seat at an end portion of the shaft, the ball seat defines a seating surface, the ball is positioned on the ball seat at the seating surface of the ball seat and defines a central passage, an outer surface of the ball is complementary to the seating surface of the ball seat, the ball shoe is positioned opposite the ball seat about the ball and defines a circular opening, the ball shoe defines a seating surface, the ball is positioned on the seating surface of the ball shoe, the outer surface of the ball is complementary to the seating surface of the ball shoe, the housing is mounted to the ball seat and positioned over the ball and the ball shoe, the spring is positioned within the housing and the spring urges the ball shoe against the ball, and wherein a threaded stud is received within the central passage of the ball and extends through the circular opening of the ball shoe.

10. The linear compressor of claim 9, wherein the coupling defines an axial direction, the shaft extending between a first end portion and a second end portion along the axial direction, the ball seat and the ball shoe spaced apart from each other along the axial direction for each ball joint of the pair of ball joints.

11. The linear compressor of claim 10, wherein the first end portion of the shaft is positioned at the piston and the second end portion of the shaft is positioned at the inner back iron assembly, the ball seat of one of the pair of ball joints mounted to the shaft at the first end portion of the shaft, the ball seat of another one of the pair of ball joints mounted to the shaft at the second end portion of the shaft.

12. The linear compressor of claim 9, wherein the housing comprises a cylindrical sidewall and an end wall for each ball joint of the pair of ball joints, the end wall of the housing defining a frustoconical opening for each ball joint of the pair of ball joints, the threaded stud passing through the frustoconical opening away from the shaft along an axial direction.

13. The linear compressor of claim 12, wherein the spring extends between the ball shoe and the end wall of the housing within the housing for each ball joint of the pair of ball joints.

14. The linear compressor of claim 9, wherein the outer surface of the ball is spherical for each ball joint of the pair of ball joints, the seating surface of the ball seat and the seating surface of the ball shoe being semispherical for each ball joint of the pair of ball joints.

15. The linear compressor of claim 9, wherein the housing is threaded onto the ball seat for each ball joint of the pair of ball joints.

16. The linear compressor of claim 1, wherein the housing is rigidly mounted to the ball seat using a threaded connection.

17. The linear compressor of claim 9, wherein the housing is rigidly mounted to the ball seat using a threaded connection.

* * * * *